US008708749B2

(12) United States Patent
Suenaga et al.

(10) Patent No.: US 8,708,749 B2
(45) Date of Patent: Apr. 29, 2014

(54) HIGH-SPEED INTERFACE CONNECTOR

(75) Inventors: Hiroshi Suenaga, Osaka (JP); Yutaka Nakamura, Kyoto (JP); Yukihiro Fukumoto, Osaka (JP)

(73) Assignee: Panasonic Corporation, Osaka (JP)

( * ) Notice: Subject to any disclaimer, the term of this patent is extended or adjusted under 35 U.S.C. 154(b) by 45 days.

(21) Appl. No.: 13/574,863

(22) PCT Filed: Feb. 3, 2012

(86) PCT No.: PCT/JP2012/000727

§ 371 (c)(1),
(2), (4) Date: Jul. 24, 2012

(87) PCT Pub. No.: WO2012/111270

PCT Pub. Date: Aug. 23, 2012

(65) Prior Publication Data

US 2013/0045635 A1 Feb. 21, 2013

(30) Foreign Application Priority Data

Feb. 14, 2011 (JP) ..... 2011-028303

(51) Int. Cl.
*H01R 24/00* (2011.01)

(52) U.S. Cl.
USPC ..... 439/629

(58) Field of Classification Search
USPC ..... 439/629, 159, 160, 155, 152
See application file for complete search history.

(56) References Cited

U.S. PATENT DOCUMENTS 6,981,885 B2 * 1/2006 Oh ..... 439/159
7,140,894 B2 * 11/2006 Tsai ..... 439/159
7,670,160 B2 * 3/2010 Tsuji ..... 439/159
2005/0101170 A1 5/2005 Tanaka et al.
2011/0145465 A1 6/2011 Okada

FOREIGN PATENT DOCUMENTS

JP 2004-71175 3/2004
JP 2010-61474 3/2010
JP 2010-80416 4/2010
JP 2011-146020 7/2011

OTHER PUBLICATIONS

International Preliminary Report on Patentability issued Aug. 29, 2013 in corresponding International (PCT) Application No. PCT/JP2012/000727.

International Search Report issued Apr. 10, 2012 in International (PCT) Application No. PCT/JP2012/000727.

* cited by examiner

*Primary Examiner* — Jean F Duverne
(74) *Attorney, Agent, or Firm* — Wenderoth, Lind & Ponack, L.L.P.

(57) ABSTRACT

A high-speed interface connector is used for connecting a cable or a memory card each having a differential transmission system signal pin arrangement including a pair of differential transmission signaling pins that are adjacent to each other and two stable potential pins provided on both sides of the pair of differential transmission signaling pins, the two stable potential pins having potentials different from each other. The connector includes: a first and a second contact terminals for differential transmission respectively connected to the pair of differential transmission signaling pins; and a third and a fourth contact terminals provided on both sides of the first and the second contact terminal, the third contact terminal adjacent to the first contact terminal being connected to one of the two stable potential pins, and the fourth contact terminal adjacent to the second contact terminal having a potential identical to that of the third contact terminal.

17 Claims, 7 Drawing Sheets

HIGH-SPEED INTERFACE CONNECTOR

BACKGROUND

1. Technical Field

This application is based on and claims the benefit of priority from Japanese Patent Application No. 2011-28303, filed in Japan on Feb. 14, 2011, the content of which is incorporated herein by reference.

The present invention relates to high-speed interface connectors for connecting a differential transmission system signal pin arrangement. In particular, the present invention relates to such as a memory card socket for insertably connecting a memory card having a differential transmission system signal pin arrangement, and a USB cable connector for connecting a USB cable.

2. Background Art

In these days, memory cards are widely used as storage media for storing pictures and movies that are taken by such as digital still camera and a digital video camera, as well as storage media for mobile phones for storing various contents including pictures and movies. In addition, memory cards are also used as bridge media when various contents stored in the electronic devices described above (hereinafter referred to as host devices) are moved or copied to a personal computer.

A typical memory card includes a plurality of signal pins, a power pin, and a ground pin on a surface of the memory card. Further, the memory card is internally configured by a printed-circuit board, and such as a controller LSI and a flash memory mounted on the printed-circuit board. The plurality of pins on the surface of the memory card are electrically connected to respective terminals of the controller LSI (such as a signal terminal, a power terminal, and a ground terminal) through wiring provided on the printed-circuit board.

On the other hand, a typical host device is provided with a memory card socket, and the host device and the memory card are electrically connected by the memory card being inserted into the memory card socket, and reading and writing of data are performed.

Further, the memory card socket is configured by such as a body for holding the memory card, a cover shell, and contact terminals. The contact terminals are fixed to the body so as to be brought into contact with the plurality of pins provided on the surface of the memory card when the memory card is inserted into the memory card socket. It should be noted that descriptions for components that are not related to the present invention are omitted. Examples of the memory card socket are disclosed in Japanese Patent Laid-open Publication 2010-61474 A and Japanese Patent Laid-open Publication 2004-71175 A.

SUMMARY OF THE INVENTION

Improvements in functionalities of host devices have increasingly improve quality of pictures and movies to be recorded, and storage capacity of memory cards have also been increasing in conjunction. However, as an increased data volume to be handled also increases time required for data transmission between a host device and a memory card and reduces convenience, it has been demanded for memory cards to be improved in speed for data transmission between a host device and a memory card as the storage capacity of memory cards increases.

There are several possible approaches in order to improve speed for transmission between a host device and a memory card. One of these is to improve a transmission rate of a signal transmission system for transmission with a host device via existing signal pins of a memory card. The conventional memory cards have employed a single-ended transmission system as a signal transmission system with a host device, and handled an increased storage capacity of the memory cards by improving the transmission rate.

However, the single-ended transmission system is a transmission system of transmitting one bit signal per signal line, and susceptible to an external noise. Therefore, it is necessary to use relatively large signal amplitude such as 3.3 V and 1.8 V. Accordingly, it is necessary to reduce rise time of signals in order to increase the transmission rate, that is, to improve signal frequency. In the single-ended transmission system, while the signal frequency has been improved and the rise time of signals haven been reduced, the reduction of rise time of signals is reaching a limit due to large signal amplitude.

Other approaches of improving the transmission speed between a host device and a memory card include introducing a differential transmission system that has been widely used these days in high-speed signal transmission between devices using a cable, instead of the conventionally used single-ended transmission system. The differential transmission system is a method of transmitting signals using a pair of signal lines, that is, two signal lines. One of the pair of signal lines transmits a signal of the same phase as a signal to be transmitted (positive-phase signal), and the other of the signal lines transmits a signal of a phase opposite (reversed phase) from the signal to be transmitted (negative-phase signal) at the same time, and a difference between the signals is detected on the reception side. In the differential transmission system, it is possible to reduce amplitude of both a positive-phase signal and a negative-phase signal, because a difference between the positive-phase signal and the negative-phase signal is detected on the reception side. Accordingly, the rise time can be easily reduced, and it is possible to transmit signals at higher speed than the single-ended transmission system. Further, in the differential transmission, wiring for both the positive-phase signal and the negative-phase signal are closely provided, and therefore even when the positive-phase signal and the negative-phase signal are affected by an external noise, the external noise is typically superimposed on the positive-phase signal and the negative-phase signal equally. Accordingly, the external noise equally superimposed on both signals is canceled by obtaining a difference between the positive-phase signal and the negative-phase signal on the reception side. Thus, the differential transmission system has a feature that signals are insusceptible to external noises.

Additionally providing dedicated pins used exclusively for differential transmission is one method of introducing the differential transmission system to memory cards that have performed signal transmission with a host device using the single-ended transmission system. When additionally providing new pins to an existing memory card, an area for newly provided pins is restricted. In addition, a memory card to be provided with new pins requires a pin arrangement such that when the memory card is inserted into a memory card socket, contact terminals of the memory card socket that are connected to the existing signal pins may not go wrong during insertion of the memory card even if the terminals are brought into contact with the new pins. Alternatively, the memory card requires a pin arrangement such that the new pins may not be brought into contact with the contact terminals of the memory card socket that are connected to the existing signal pins during insertion of the memory card into the memory card socket.

On the other hand, there is a case in which the memory card has a pin arrangement including a ground pin P7(G), differential pins P8(S+) and P9(S−), and a power pin P10(V2) as shown by Dif1 in FIG. 2, for example, as not being able to provide ground terminals on both sides of the differential signal pair for differential transmission. In this manner, when stable potential pins of different potentials are provided on both sides of the differential pins P(S+) and P(S−) as the differential signal pair, quality of the differential signals possibly degrades due to a crosstalk noise superimposed from P7(G) onto P8(S+) and a crosstalk noise superimposed from P10(V2) onto P9(S−). This is because when uncorrelated current components that respectively flow through the stable potential pins P7(G) and P10(V2) on both sides of the differential pins P8(S+) and P9(S−) are respectively superimposed on the differential signals as crosstalk noises, it is not possible on the side of receiving the differential signals (a differential receiver, not depicted in the drawings) to cancel the uncorrelated crosstalk noises.

An application of the differential transmission system described above is not limited to memory cards, but used for various specifications. The differential transmission system is also used as a specification for connecting cables for connecting between devices, such as USB cables. Therefore, the above problem has also been observed in connection between a substrate and equipment of these devices, between a connecting cable and a connector, and the like.

Thus, an object of the present invention is to provide a high-speed interface connector providing connection for a differential transmission system signal pin arrangement having such a pin arrangement including differential transmission pins P(S+) and P(S−) and stable potential pins of different potentials adjacently provided on left and right sides of the differential pair pins, the high-speed interface connector being capable of reducing degradation of quality of differential signals.

More specifically, an object of the present invention to provide a high-speed interface connector configured to reduce degradation of quality of differential signals for such as a memory card and a USB cable having such a pin arrangement including differential transmission pins P(S+) and P(S−) and stable potential pins of different potentials adjacently provided on left and right sides of the differential pair pins as shown by Dif1 in FIG. 2.

In order to address the conventional problems, a high-speed interface connector according to the present invention is a high-speed interface connector for connecting one of a cable and a memory card each having a differential transmission system signal pin arrangement including a pair of differential transmission signaling pins that are adjacent to each other and two stable potential pins provided on both sides of the pair of differential transmission signaling pins, the two stable potential pins having potentials different from each other, the connector provided with:

a first and a second contact terminals that are adjacent to each other for differential transmission and respectively connected to the pair of differential transmission signaling pins; and a third and a fourth contact terminals provided on both sides of the first and the second contact terminals, the third contact terminal adjacent to the first contact terminal being connected to one of the two stable potential pins, and the fourth contact terminal adjacent to the second contact terminal having a potential identical to that of the third contact terminal.

The high-speed interface connector can be further provided with a fifth contact terminal connected to the other of the two stable potential pins.

Moreover, a memory card socket according to the present invention is a memory card socket that supports a memory card for a differential transmission system including: a card pin arrangement, in which a first and a second pins adjacent to each other are differential transmission signaling pins, out of a third and a fourth pins that are adjacent on both sides of the pair of the first and the second pin, the third pin is adjacent to the first pin and on the side opposite of the second pin with respect to the first pin, the fourth pin is adjacent to the second pins and on the side opposite of the first pin with respect to the second pin, the third and the fourth pin have potentials different from each other; and a fifth pin connected to a stable potential identical to that of the fourth pin, the memory card socket provided with:

a first and a second differential transmission contact terminal that are adjacent to each other and respectively connected to the first and the second differential transmission signaling pins of the memory card; and a third and a fourth contact terminals provided adjacent on both sides of the pair of the first and the second contact terminals, the third contact terminal being adjacent to the first contact terminal and positioning on the side opposite of the second contact terminal with respect to the first contact terminal, the fourth contact terminal being adjacent to the second contact terminal and positioning on the side opposite of the first contact terminal with respect to the second contact terminal, wherein the fourth contact terminal is connected to the fourth pin of the memory card, and the third contact terminal is connected to the fifth pin connected to the stable potential identical to that of the fourth pin instead of the third pin of the memory card.

With a configuration of the memory card socket according to the present invention, the memory card socket supporting the memory card in which the pins on the both sides of the differential pin pair are not stable potential pins of the same potential can make the contact terminal pair on the both sides of the contact terminal pair of the memory card socket connected to the differential pin pair of the memory card have the stable potentials of the same potential.

According to the high-speed interface connector of the present invention, in differential signal communication between differential transmission signal pins and a host device where pins on both sides of the differential pin pair are not stable potential pins of the same potential, the high-speed interface connector allows crosstalk from the two stable potential pins on the both sides of the contact terminal pair that transmit differential signals to be correlated. Therefore, as the correlated crosstalk are cancelled on a receiving end of the differential signals, it is possible to provide an effect of reducing degradation of quality of differential signals.

BRIEF DESCRIPTION OF DRAWINGS

The present invention will become readily understood from the following description of preferred embodiments thereof made with reference to the accompanying drawings, in which like parts are designated by like reference numeral and in which:

FIG. 3A is a top view of the memory card socket, and dotted and dashed lines illustrate a transparent view covered under a cover shell, FIG. 3B is a rear view of the memory card, FIG. 3C is a cross-sectional view taken along line A1-B1 in FIG. 3A, FIG. 3D is a rear view when a memory card is inserted, and FIG. 3E is a cross-sectional view taken along line A2-B2 in FIG. 3D;

FIG. 4A is a top view of the memory card socket, and dotted and dashed lines illustrate a transparent view covered under a cover shell, FIG. 4B is a rear view of the memory card socket, FIG. 4C is a cross-sectional view taken along line A3-B3 in FIG. 4A (identical to a cross-sectional view taken along the same line in FIG. 6A), FIG. 4D is a rear view when a memory card is inserted, and FIG. 4E is a cross-sectional view taken along line A4-B4 in FIG. 4D (identical to a cross-sectional view taken along the same line in FIG. 6C);

FIG. 6A is a top view of the memory card socket, dotted and dashed lines illustrate a transparent view under a cover shell, FIG. 6B is a rear view of the memory card socket, and FIG. 6C is a rear view when a memory card is inserted;

DETAILED DESCRIPTION

Figure 1:
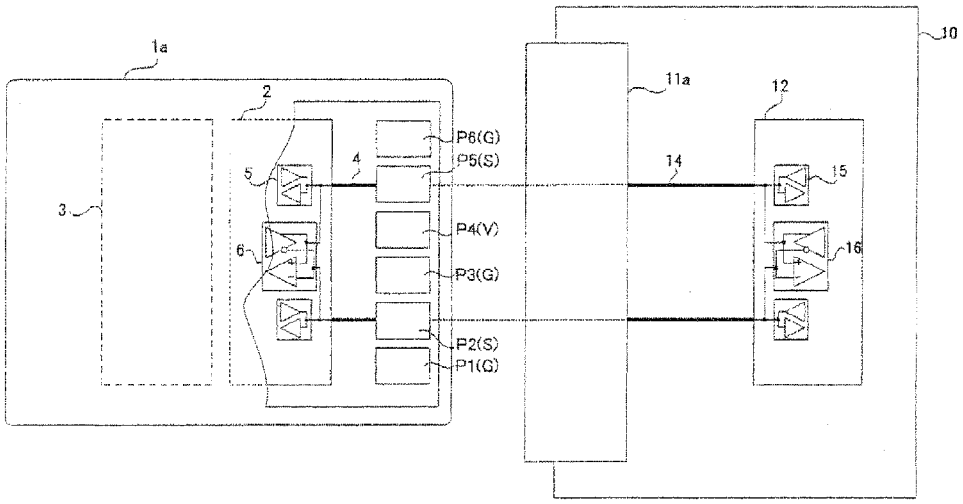
FIG. 1 is a schematic diagram illustrating a configuration of a memory card of a reference example 1 in a case in which a differential interface is introduced to a memory card of a single-ended interface.

Hereinafter, a high-speed interface connector according to embodiments will be described with reference to the appended drawings. In the drawings, substantially like components are denoted by like reference numerals.

<Memory Card>

First, a memory card to which a differential transmission system is introduced will be described.

There are two possible methods for realizing introduction of the differential transmission system to memory cards that have been conducted signal transmission with a host device based on a single-ended transmission system.

Reference Example 1

One of these is to share existing signal pins P(S) of a memory card as illustrated in FIG. 1, between both transmission systems of single-ended transmission and differential transmission (hereinafter referred to as a "pin sharing configuration"). A memory card employing the "pin sharing configuration" is assumed to be a memory card of a reference example 1. According to the "pin sharing configuration", a controller LSI 2 within the memory card includes a single-ended transmission I/O circuit 5, and a differential transmission I/O circuit 6 (a controller LSI 12 on a host device side has the same configuration). Further, the single-ended I/O circuit 5 and the differential transmission I/O circuit 6 share wiring 4 on a printed-circuit board within a memory card 1*a*, contact terminals (not depicted) of a memory card socket 11*a*, wiring 14 on a printed-circuit board within a host device.

As described above, the differential transmission system allows signal transmission on the order of GHz that is far higher than the single-ended transmission. In order to realize such a high-speed transmission, it becomes important to match characteristic impedance for an entire transmission path more than a case of the single-ended transmission. However, when performing the differential transmission in the "pin sharing configuration", a component in a load capacitance of the single-ended transmission I/O circuit 5 can disturb impedance matching in the transmission path, and interrupts high-speed signal transmission based on the differential transmission system. Accordingly, the "pin sharing configuration" is not necessarily a best suited configuration in order to realize high-speed signal transmission on the order of GHz employing the differential transmission system.

Reference Example 2

Another method for realizing the introduction of the differential transmission system to memory cards that have been conducted signal transmission with a host device based on the single-ended transmission system is to additionally provide dedicated pins used exclusively for differential transmission (hereinafter referred to as a "differential pin addition configuration"). A memory card employing the "differential pin addition configuration" is assumed to be a memory card of a reference example 2.

Figure 2:
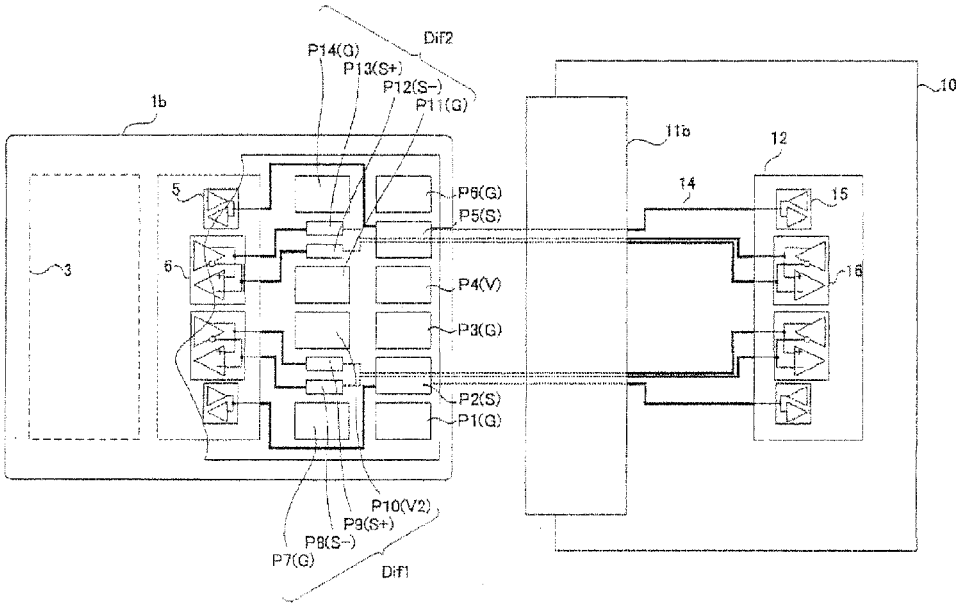
FIG. 2 is a schematic diagram illustrating a configuration of a memory card of a reference example 2 in a case in which a differential interface is introduced to a memory card of a single-ended interface (a configuration expected when the present invention is implemented)
Figure 3A:
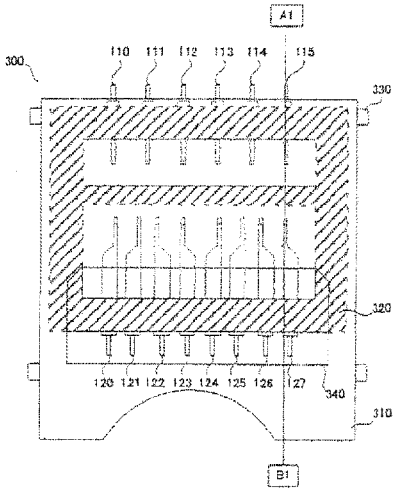
FIGS. 3A-3E show an example of a memory card socket according to an embodiment 1 that supports the memory card illustrated in FIG. 2, where
Figure 3B:
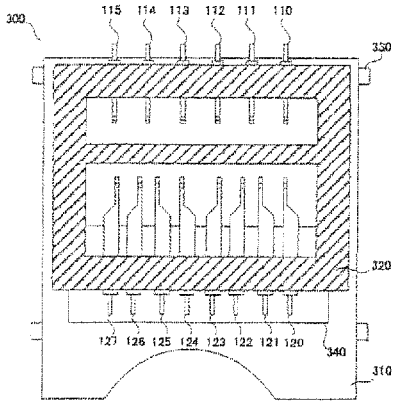
Figure 3C:
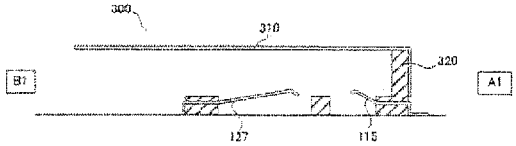
Figure 3D:
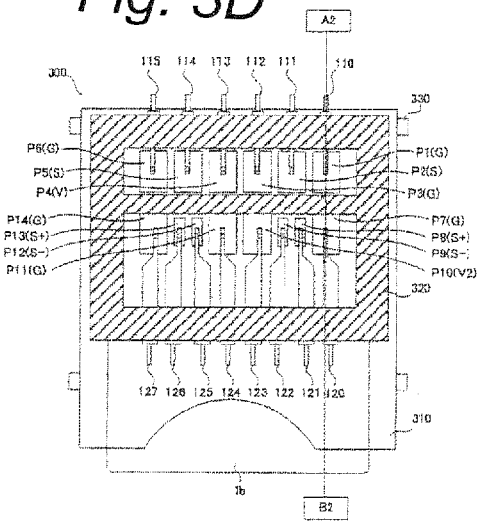
Figure 3E:
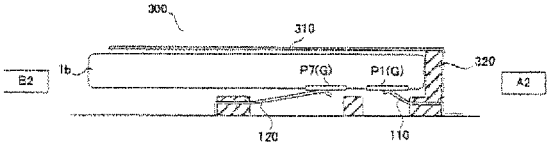

When additionally providing new differential pins to the memory card 1*a* illustrated in FIG. 1, for example, an additional pin arrangement as illustrated for a memory card 1*b* in FIG. 2 is conceivable. Among the newly provided pins of the memory card 1*b* in FIG. 2 (a second line of pins), differential pins P(S+) and P(S−) are for realizing impedance matching important in the high-speed differential transmission by being provided in a small size, reducing a component in a load capacitance generated at a pin portion, and being surrounded by stable potential pins P (GND) or P (VDD2) on both sides.

In a pin arrangement at a connector portion of a high-speed differential transmission interface such as S-ATA (Serial ATA) and PCI Express, ground pins are usually provided on both sides of the differential pin pair. However, when new pins are added to the existing memory card as in a case of the background, an area for the newly provided pins is restricted. In addition, a memory card to be provided with new pins requires a pin arrangement such that when the memory card is inserted into a memory card socket, contact terminals of the memory card socket that are connected to the existing signal pins may not go wrong during insertion of the memory card even if the terminals are brought into contact with the new pins. Therefore, there is often a case in which the memory card has a pin arrangement including a ground pin P7(G), differential pins P8(S+) and P9(S−), and a power pin P10(V2) as shown by Dif1 in FIG. 2, for example, as not being able to provide ground terminals on both sides of a differential signal pair.

As the second line in the pin arrangement of the memory card 1*b* illustrated in FIG. 2, the pin arrangement in which both sides of the differential pins P(S+) and P(S−) are surrounded by pins of stable potentials is preferable in terms of the impedance matching. However, when the stable potential pins of different potentials are provided on both sides of the differential pins P(S+) and P(S−) (Dif1), quality of the differential signals possibly degrades due to a crosstalk noise superimposed from P7(G) onto P8(S+) and a crosstalk noise superimposed from P10(V2) onto P9(S−). This is because when uncorrelated current components that respectively flow through the stable potential pins P7(G) and P10(V2) on both sides of the differential pins P8(S+) and P9(S−) are respectively superimposed on the differential signals as crosstalk noises, it is not possible on the side of receiving the differential signals (differential receiver, not depicted in the drawings) to cancel the uncorrelated crosstalk noises.

In this case, a configuration illustrated in FIG. 3A to FIG. 3E is conceivable as one example of a memory card socket 11*b* illustrated in FIG. 2. As illustrated in FIGS. 3A-3E, when an arrangement of the contact terminals respectively brought into contact with the pins of the memory card 1*b* is simply provided in the same manner as the pin arrangement of the memory card socket 11*b*, as contact terminals of a memory card socket are usually longer than the pins of the memory card 1*b*, the uncorrelated crosstalk previously described is noticeably generated at a portion of the contact terminals of the socket 11*b*.

<Memory Card Socket>

Next, a memory card socket when using a memory card of the reference example 2 to which differential transmission system is introduced will be in particular described.

Embodiment 1

Figure 4A:
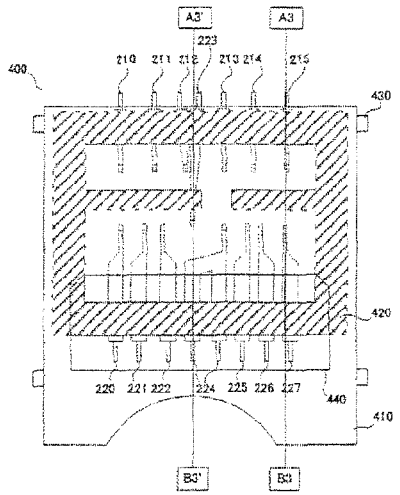
FIGS. 4A-4E show an example of a memory card socket that supports the memory card illustrated in FIG. 2, where
Figure 4B:
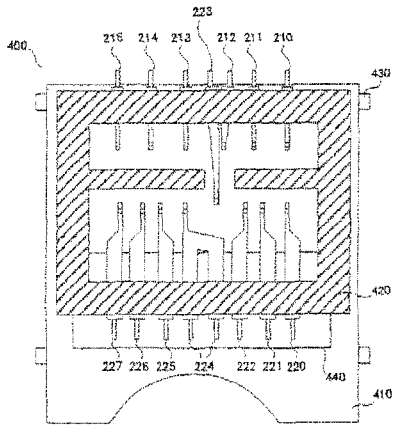
Figure 4C:
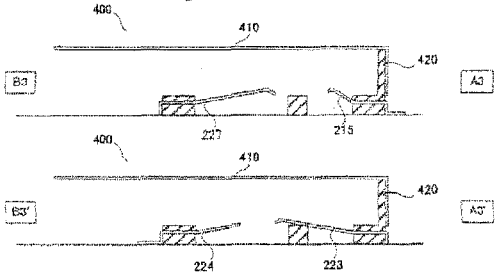
Figure 4D:
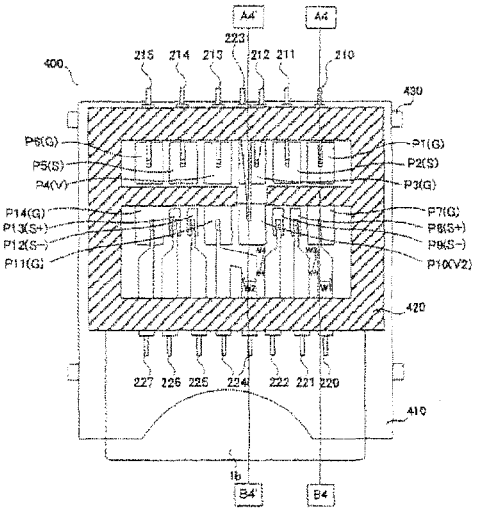
Figure 4E:
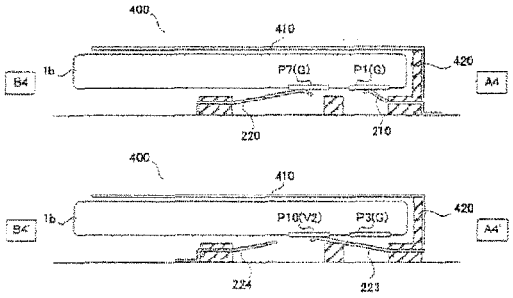

FIG. 4A to FIG. 4E are schematic diagrams illustrating a configuration of a memory card socket 400 according to an embodiment 1. Specifically, FIG. 4A is a top view of the memory card socket 400, and dotted and dashed lines illustrate a transparent view covered under a cover shell 310. Further, FIG. 4B is a rear view of the memory card socket 400. An upper view of FIG. 4C is a cross-sectional view taken along line A3-B3 in FIG. 4A, and a lower view of FIG. 4C is a cross-sectional view taken along line A3'-B3' in FIG. 4A. FIG. 4D is a schematic diagram when the memory card 1*b* including the differential transmission pins for high-speed signal transmission, and the stable potential pins of different potentials and adjacently provided on left and right side of the differential pair pins is inserted. An upper view of FIG. 4E is a cross-sectional view taken along line A4-B4 in FIG. 4D, and a lower view of FIG. 4E is a cross-sectional view taken along line A4'-B4' in FIG. 4D.

The memory card socket 400 illustrated in FIG. 4A to FIG. 4E includes contact terminals 210-227, a body 420, a cover shell 410, a cover shell fixing terminal 430, and such.

The contact terminals 210-227 are made of a conductive material and brought into contact with the pins of the memory card 1*b*, and performs signal transmission, power supply, and supply of a ground potential between the memory card 1*b* and a host device having the memory card socket 400.

The body 420 is made of a non-conductive material such as a resin material, and performs functions of fixing the contact terminals and of holding the memory card 1*b*.

The cover shell 410 is made of such as a metallic material, constitutes an outer covering of the memory card socket 400, and shields unnecessary electromagnetic radiation to outside from the memory card 1*b*.

The cover shell fixing terminal 430 is a terminal for mounting the cover shell 410 on a printed-circuit board of the host device.

The memory card socket 400 according to the embodiment 1 will be specifically described with reference to FIG. 4D. The memory card socket 400 according to the embodiment 1 is a memory card socket that supports the memory card 1*b* including the pair of differential transmission pins P8(S+) and P9(S−) and in which the stable potential pins P7(G) and P10(V2) provided adjacently to the pair of differential transmission pins are pins of different potentials. Further, out of the contact terminals provided for the memory card socket 400, the contact terminals 220 and 224 adjacent on the both sides of the contact terminals 221 and 222 connected to the pair of differential pins P8(S+) and P9(S−) of the memory card 1*b* have contact shapes connectable respectively to stable potential pin P7(G) and P11(G) of the same potential included in the memory card 1*b*.

As shown in the reference example 2, the memory card 1*b* exemplified in this embodiment has a pin arrangement including the ground pin P7(G), the differential pin P8(S+), the differential pin P9(S−), the power pin P10(V2), and the ground pin P11(G). Therefore, according to the memory card socket 400, the contact terminal 224 that is adjacent to the contact terminal 222 connected to the differential pin P9(S−) of the memory card 1*b* is connected to the ground pin P11(G), instead of the power pin P10(V2) of the memory card 1*b*. The ground pin P11(G) is a pin having a stable potential of the same potential as that of the ground pin P7(G). With this, the contact terminals 220 and 224 adjacent on the both sides of the differential transmission contact terminals P8(S+) and P9(S−) have the stable potentials of the same potential. Therefore, the current of the same phase flows through the contact terminals 220 and 224 also when a current such as a power-supply noise or a return current of a signal flows. Accordingly, crosstalk of the same phase are superimposed respectively on the differential transmission contact terminals 221 and 222, and are canceled with each other due to the advantage of the differential transmission as previously described. Therefore, these crosstalk may not affect quality of the differential signals.

At the same time, the stable potential pin P10(V2) provided next to the differential pin P9(S−) on the memory card 1*b* is connected to the contact terminal 223 of the memory card socket 400. As the contact terminal 223 is connected to the pin P10(V2) on the memory card 1*b* having a stable potential different from the potential of the contact terminals 220 and 224, a current component flowing therethrough is not correlated to current components flowing through the contact terminals 220 and 224. Therefore, in order to reduce the crosstalk from the contact terminal 223 to the differential transmission contact terminals P8(S+) and P9(S−), the contact terminal 223 is pulled to a direction different from directions in which the contact terminals 221 and 222 and the contact terminals 220 and 224 are pulled. With this, it is possible to reduce an influence of a crosstalk from the contact terminal 223.

It is desirable that an interval between the differential transmission contact terminal 222 and the contact terminal 224 be equal to an interval between the differential transmission contact terminal 221 and the contact terminal 220. This is because a combination of the contact terminal 224 and the contact terminal 222 can be balanced with a combination of the contact terminal 220 and the contact terminal 221, and as a result, a characteristic of the crosstalk noise from the contact 224 to the contact 222 can be equalized with a characteristic of the crosstalk noise from the contact 220 to the contact 221, and it is possible to improve an effect of cancellation of in phase noises of the differential transmission.

Figure 5A:
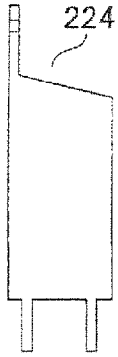
FIG. 5A to FIG. 5C are examples of a configuration of a contact terminal 224 illustrated in FIGS. 4A-4E, respectively.
Figure 5B:
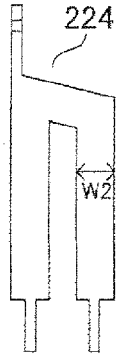
Figure 5C:
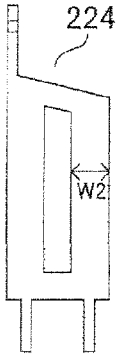

It is desirable that the contact terminal 224 has a shape illustrated in any of FIG. 5A to FIG. 5C.

The contact terminal 224 illustrated in FIG. 5A has a portion that extends adjacently and parallelly to the contact terminal 222 illustrated in FIG. 4D wider than the contact terminal 220, and a resistance value at this portion can be reduced. Accordingly, between the host device and the stable potential pin P11(G) of the memory card 1*b* can be connected with low impedance. Therefore, it is possible to achieve an effect of reducing a voltage drop when supplying power or a ground potential from the host device to the memory card 1*b*.

FIG. 5B and FIG. 5C illustrate a configuration in which a slit or a window hole is provided for a contact terminal, and the width of the portion that extends adjacently and parallelly to the contact terminal 222 illustrated in FIG. 4D is generally the same as a width of other contact terminals. With this configuration, a contact pressure generated between the memory card 1*b* and the contact terminal when inserting the card can be equalized with those at other contact terminals. Accordingly, it is possible to improve reliability of the connection between the pins of the memory card 1*b* and the contact terminals of the memory card socket 400. In addition, as a contact pressure at the contact terminal 224 can be equalized to (reduced down to a comparable contact pressure with) those at other contact terminals, it is possible to achieve an effect of reducing degradation of a surface of the pin (grinding) occurring when the contact terminal 224 is brought into contact with the pin P11(G) of the memory card 1*b*.

Figure 6A:
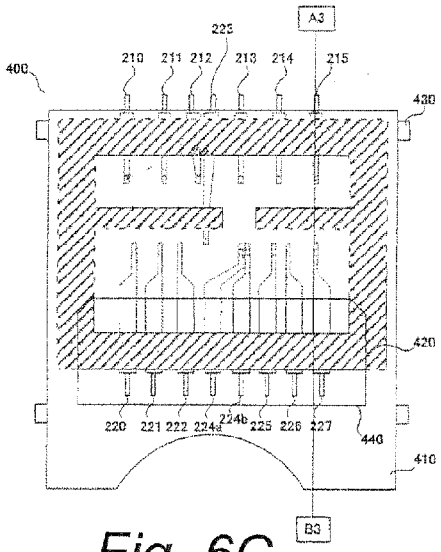
FIGS. 6A-6C shows another example of a memory card socket that supports the memory card illustrated in FIG. 2, where
Figure 6B:
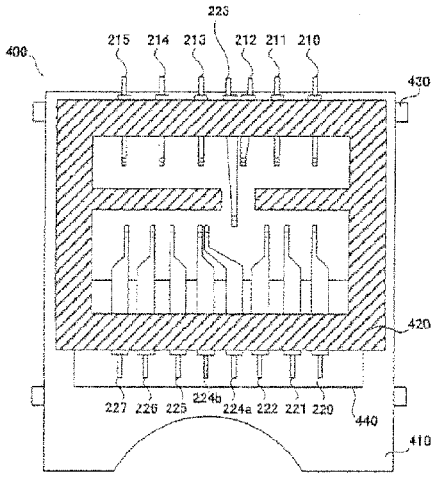
Figure 6C:
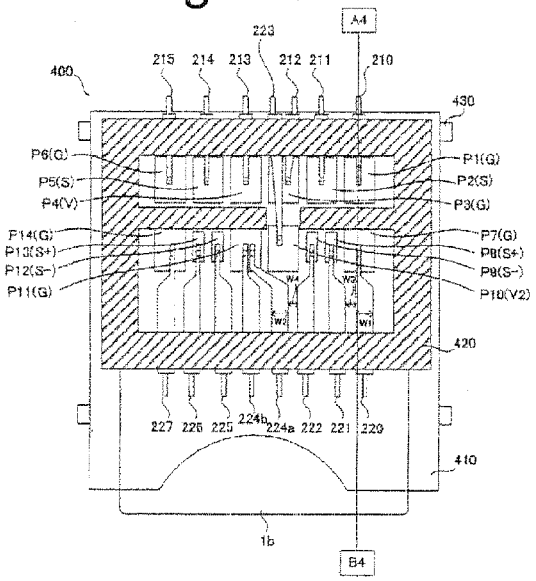

Further, instead of the contact terminal 224 illustrated in FIGS. 4A-4E, it is possible to use contact terminals 224*a* and 224*b* as illustrated in FIG. 6A, FIG. 6B, and FIG. 6C. The contact terminal 224*a* illustrated in FIG. 6A has a portion that extends adjacently and parallelly to the contact terminal 222 of FIGS. 4A-4E. The portion of the contact terminal 224*a* has a width equal to a width of the contact terminal 220 and the contact terminal 224*b*. With such a shape having same width among the contact terminals 220, 224*a*, and 224*b*, a contact pressure generated between the memory card 1*b* and the contact terminal when inserting the memory card can be equalized with those at other contact terminals. Accordingly, it is possible to improve reliability of the connection between the pins of the memory card 1*b* and the contact terminals of the memory card socket 400. In addition, as contact pressures at the contact terminals 224*a* and 224*b* can be equalized to (reduced down to a comparable contact pressure with) those at other contact terminals, it is possible to achieve an effect of reducing degradation of a surface of the pin (grinding) occurring when the contact terminals 224*a* and 224*b* are brought into contact with the pin P11(G) of the memory card 1*b*. Additionally, as the contact terminals 224*a* and 224*b* are independent contact terminals, it is possible to increase contact points of the stable potential pin P11(G) of the memory card 1*b* with the contact terminals. Therefore, it is possible to reduce a contact resistance between the stable potential pin P11(G) and the contact terminals, and to achieve an effect of reducing a voltage drop when supplying power or a ground potential from the host device to the memory card 1*b*.

Moreover, in the socket 400, it is preferable that the contact terminals 221 and 222 connected to the differential transmission pins P8(S+) and P9(S−) of the memory card 1*b* have line-symmetric shapes as much as possible. In addition, it is desirable that the contact terminal 220 connected to the stable potential pin P7(G) has line-symmetric shape as much as possible with a portion of the contact terminal 224 connected to the pin P11(G) having the same potential as that of the stable potential pin P7(G), the portion extending adjacently and parallelly to the contact terminal 222. Also with this configuration, the contact terminals 221 and 222 can be balanced from a combination of the contact terminals of the stable potential adjacent on the both ends of the contact terminals 221 and 222. Therefore, it is possible to improve an effect of cancellation of in phase noises of the differential transmission, and to achieve an effect of maintaining quality of differential signals.

For example, as illustrated in FIG. 5B, it is preferable that the contact terminal 224 is provided in an "h" shape, and a width w2 is equal to a width w1 of the contact terminal 220.

Further, when the contact terminals 224*a* and 224*b* illustrated in FIG. 6A, FIG. 6B, and FIG. 6C are provided instead of the contact terminal 224, it is possible to achieve the same effect by providing the width w2 of the portion that extends adjacently and parallelly to the contact terminal 222 of the contact terminal 224*a* to have a shape line-symmetric as much as possible with the width w1 of the contact terminal 220.

Moreover, in the memory card socket 400 illustrated in FIGS. 4A-4E, it is preferable that the contact terminals 221 and 222 connected to the differential transmission pins P8(S+) and P9(S−) of the memory card 1*b* have shapes line-symmetric as much as possible, and that the contact terminal 220 connected to the stable potential pin P7(G) have a shape line-symmetric as much as possible with the portion of the contact terminal 224 that extends adjacently and parallelly to the contact terminal 222 and connected to the pin P11(G) having the same potential as that of the stable potential pin P7(G) (for example, the width w1 and the width w2 in FIG. 4D are equal). In addition, it is desirable that an interval between the differential transmission contact terminal 222 and the contact terminal 224 for supplying a stable potential be equal to an interval between the differential transmission contact terminal 221 and the contact terminal 220 for supplying a stable potential (a width w3 and a width w4 are equal).

Such a shape of the contact terminal and an interval between the contact terminals can cause to balance the combination of the contact terminal 224 and the contact terminal 222 with the combination of the contact terminal 220 and the contact terminal 221, and therefore it is possible to further improve the effect of cancellation of in phase noises of the differential transmission.

When replacing the contact terminal 224 of the memory card socket illustrated in FIG. 4 with the contact terminals 224*a* and 224*b* illustrated in FIGS. 6A-6C, it is also possible to achieve the same effect by employing a configuration described below. Specifically, in the memory card socket 400, it is preferable that the contact terminals 221 and 222 of the memory card socket 400 connected to the differential transmission pins P8(S+) and P9(S−) of the memory card 1*b* have shapes line-symmetric as much as possible (for example, the width w1 and the width w2 in FIG. 4D are equal). It is also preferable that the contact terminal 220 connected to the stable potential pin P7(G) have a shape line-symmetric as much as possible with the portion of the contact terminal 224*a* that extends adjacently and parallelly to the contact terminal 222 and connected to the pin P11(G) having the same potential as that of the stable potential pin P7(G). In addition, by making the interval w4 between the contact terminal 222 and the contact terminal 224*a* equal to the interval w3 between the contact terminal 221 and the contact terminal 220, it is possible to even further improve the effect of cancellation of in phase noises of the differential transmission.

Embodiment 2

Figure 7:
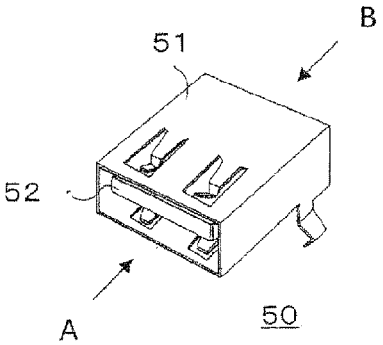
FIG. 7 is a schematic perspective view illustrating a configuration of a conventional USB connector.
Figure 8:
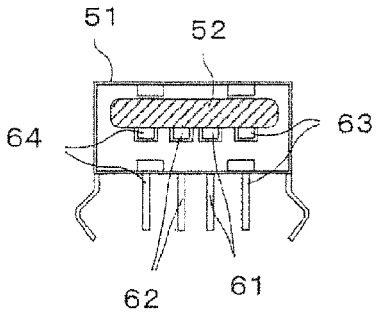
FIG. 8 is a front view of the USB connector illustrated in FIG. 7 viewed from a cable connecting surface (A) of the USB connector.
Figure 9:
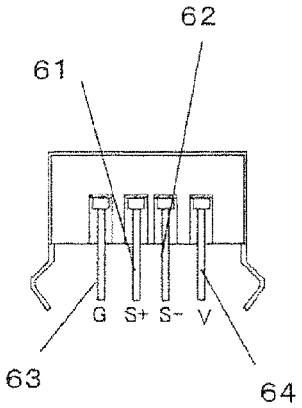
FIG. 9 is a back view of the USB connector illustrated in FIG. 7 viewed from a back surface (B) of the USB connector.
Figure 10A:
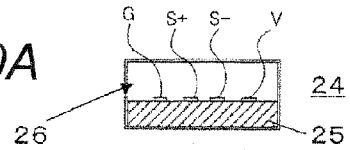
FIG. 10A is a front view of the connecting surface of a USB cable.
Figure 10B:
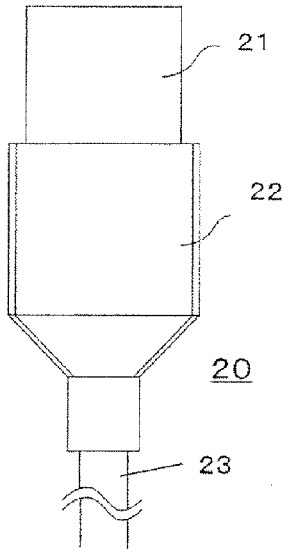
FIG. 10B is a plan view of the USB cable.
Figure 10C:
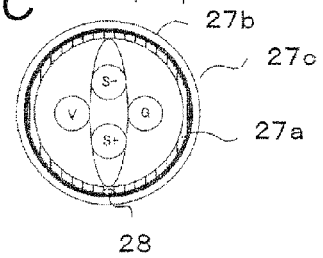
FIG. 10C is a cross-sectional view illustrating a cross-sectional structure of the USB cable.
Figure 11A:
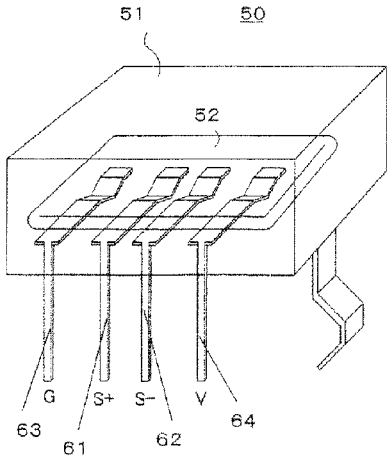
FIG. 11A is a perspective view illustrating a configuration of the conventional USB connector on a side of the back surface.
Figure 11B:
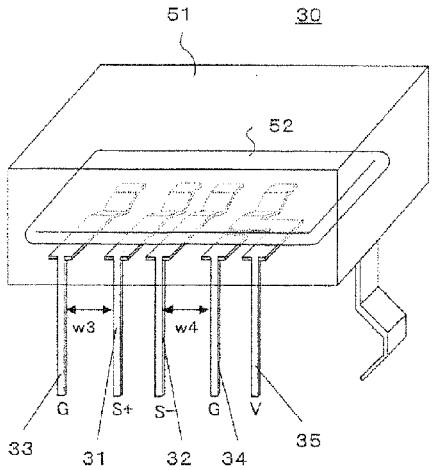
FIG. 11B is a perspective view illustrating a configuration of a USB connector according to an embodiment 2 on a side of a back surface.

FIG. 7 is a schematic perspective view illustrating a configuration of a conventional USB connector 50. Further, FIG. 8 is a front view of the USB connector 50 illustrated in FIG. 7 viewed from a cable connecting surface (A) of the USB connector. FIG. 9 is a back view of the USB connector 50 in FIG. 7 viewed from a back surface (B) of the USB connector. Moreover, FIG. 10A is a front view of a USB terminal 21 of a connecting surface of a USB cable 20, FIG. 10B is a plan view of the USB cable 20 near its end, and FIG. 10C is a cross-sectional view illustrating a cross-sectional structure of a cable portion 23 of the USB cable 20. FIG. 11A is a perspective view illustrating a configuration of the conventional USB connector 50 on a side of a back surface, and FIG. 11B is a perspective view illustrating a configuration of a USB connector 30 according to the embodiment 2 on a side of a back surface.

As illustrated in the cross-sectional view of the cable portion 23 in FIG. 10C, the USB cable 20 is configured such that four lines including a pair of differential transmission pins P(S+) and P(S−), a ground potential G, and a power source potential V are provided substantially at equal intervals within the cross-sectional view. Accordingly, in a state at the cable portion 23 of the USB cable 20, even when noises are superimposed on the differential transmission pins P(S+) and P(S−) respectively from the ground potential G and the power source potential V, the noises are substantially equally superimposed on the differential transmission pins P(S+) and P(S−). Therefore, it is possible to cancel the noises at the cable portion 23 of the USB cable 20. Here, the cable portion 23 includes therein four lines of the pair of differential transmission pins P(S+) and P(S−), the ground potential G, and the power source potential V, and covered by an internal shield 27*a*, a polyvinyl chloride jacket 27*b*, and an external shield 27*c* in the stated order from inside to outside. Further, a drain wire 28 is provided.

On the other hand, as illustrated in the plan view of FIG. 10B, a USB terminal 24 for connection with the connector at an end of the USB cable 20 includes an end portion covered by a rectangular shell 21 via an overmold portion 22 from the cable portion 23 having a circular cross section. As illustrated in the front view of FIG. 10A, the end portion covered by the shell 21 is provided with an insulating portion 25 at a lower portion, the pair of differential transmission pins P(S+) and P(S−) above the insulating portion 25, and a terminal of the ground potential G and a terminal of the power source potential V on both sides of the pair of pins P(S+) and P(S−). Further, a gap portion 26 is provided above these.

As illustrated in the perspective view of FIG. 7, the conventional USB connector 50 is surrounded by a shell 51, and includes the cable connecting surface (A) and the back surface (B). Here, an insulating portion is provided within the cable connecting surface (A). When the USB connector 50 is viewed from the cable connecting surface (A), as illustrated in FIG. 8, an insulating portion 52 is provided at an upper portion, and four contact terminals 63, 61, 62, and 64 that are respectively connected to the pins of the ground potential G of the USB terminal 24, the differential transmission pins P(S+) and P(S−), and the power source potential V are provided in a line at a lower portion. Here, the insulating portion 52 above the USB connector 50 is housed within the gap portion 26 on a side of the USB terminal 24. Accordingly, when inserting the USB connector 50 by turning the USB terminal 24 over, it is practically not possible to insert the USB connector 50, as the insulating portions 25 and 52 are facing each other. In other words, the insulating portion 25 of the USB terminal 24 and the insulating portion 51 of the USB connector 50 are provided in order to restrict a direction for inserting the USB terminal 24 into the USB connector 50 to one direction.

Further, when the USB connector 50 is viewed from the back surface (B), as illustrated in FIG. 9, the four contact terminals 63, 61, 62, and 64 connected to the pins of the ground potential G of the USB terminal 24, the differential transmission pins P(S+) and P(S−), and the power source potential V are directed downward from the connector 50. In this case, the four contact terminals 63, 61, 62, and 64 respectively correspond to the pins of the ground potential G of the USB terminal 20, the differential transmission pins P(S+) and P(S−), and the power source potential V. In addition, potentials of the third and the fourth contact terminal 63 and 64 corresponding to the pins of the stable potentials on the both sides are different from each other. Therefore, similarly to the memory card described above, there is a problem that when current components uncorrelated to the first and the second contact terminal 61 and 62 respectively corresponding to the differential signal pins are respectively superimposed on the differential signals as crosstalk noises at the USB connector 50, it is not possible on the side of receiving the differential signals (the differential receiver, not depicted in the drawings) to cancel the uncorrelated crosstalk noises.

Therefore, as is clear from comparison with the conventional USB connector 50 illustrated in FIG. 11A and as illustrated in the perspective view of FIG. 11B, the USB connector 30 according to the embodiment 2 is provided with contact terminals 33 and 34 both corresponding to the ground potential G as two of a third and a fourth contact terminal 33 and 34 on both sides of a pair of a first and a second contact terminal 31 and 32 connected to the differential transmission pins P(S+) and P(S−) of the USB terminal 24. With this, it is possible to make two of the third and the fourth contact terminal 33 and 34 of stable potentials on the both sides of the pair of the first and the second contact terminal 31 and 32 connected to the differential transmission pins P(S+) and P(S−) of the USB terminal 24 have the same ground potential. Thus, noises superimposed on the pair of the first and the second contact terminal 31 and 32 from the third and the fourth contact terminal 33 and 34 of stable potentials having the same ground potential can be removed as crosstalk noises as the noises are of the same phase.

It should be noted that a fifth contact terminal 35 connected to the power source potential V of the USB terminal 20 is flexed outward more than the fourth contact terminal 34 of the ground potential G and taken out, in order to make a portion that is adjacent to the pair of the first and the second contact terminal 31 and 32 connected to the differential transmission pins P(S+) and P(S−) shorter. The fifth contact terminal 35 can be provided as needed.

Further, as illustrated in FIG. 11(*b*), it is preferable that an interval w3 of a portion at which the first contact terminal 31 and the third contact terminal 33 extend adjacently and parallelly to each other be equal to an interval w4 of a portion at which the second contact terminal 32 and the fourth contact terminal 34 extend adjacently and parallelly to each other.

Further, it is preferable that the first contact terminal 31 and the second contact terminal 32 have line-symmetric shapes, and a portion of the third contact terminal 33 that extends adjacently and parallelly to the first contact terminal 31 has line-symmetric shape with the fourth contact terminal 34.

Moreover, it is preferable that the third contact terminal 33 is provided with a portion that extends adjacently and parallelly to the first contact terminal 31, and the portion of the third contact terminal 33 that extends adjacently and parallelly to the first contact terminal 31 has line-symmetric shape with the fourth contact terminal 34.

Furthermore, it is preferable that the interval w3 between the portion that extends adjacently and parallelly to the first contact terminal 31 of the third contact terminal 33 and the first contact terminal 31 be equal to the interval w4 between the second contact terminal 32 and the fourth contact terminal 34, and that the portion of the third contact terminal 33 that extends adjacently and parallelly to the first contact terminal 31 has a width equal to a width of the fourth contact terminal 34.

The high-speed interface connector is a high-speed interface connector that supports such as memory cards and cables with a differential transmission system signal pin arrangement having such a pin arrangement including a pair of differential transmission pins and stable potential pins of different potentials adjacently provided on both sides of the pair of differential pins. The high-speed interface connector has a feature that two contact terminals on both sides of a pair of contact pins connected to the differential transmission pins in the differential transmission system signal pin arrangement are connected to stable potential pins of the same potential in the differential transmission system signal pin arrangement, and is useful as a high-speed interface connector for high-speed differential transmission.

DESCRIPTION OF REFERENCE CHARACTERS

1*a*, 1*b* memory card
2, 12 controller LSI
3 flash memory
4, 14 wiring on printed-circuit board
5, 15 single-ended I/O circuit
6, 16 differential transmission I/O circuit
10 host device
11*a*, 11*b* memory card socket
110-127, 210-227 contact terminal of memory card socket
300, 400 memory card socket
310, 410 cover shell
320, 420 body
330, 430 cover shell fixing terminal
340, 440 window hole of cover shell
P(P1(G), P2(S) . . . P14(G)) card pin
Dif1, Dif2 portion indicating differential pin pair and stable potential pins on both sides thereof
20 USB cable
21 shell
22 overmold portion
23 cable portion
24 USB terminal
25 insulating portion
26 gap portion
27*a* internal shield
27*b* polyvinyl chloride jacket
27*c* external shield
28 drain wire
30 USB connector
31 first contact terminal
32 second contact terminal
33 third contact terminal
34 fourth contact terminal
35 fifth contact terminal
50 USB connector
51 shell
52 insulating portion
61 first contact terminal
62 second contact terminal
63 third contact terminal
64 fourth contact terminal

The invention claimed is:

1. A high-speed interface connector for connecting one of a cable and a memory card each having a differential transmission system signal pin arrangement including a pair of differential transmission signaling pins that are adjacent to each other and two stable potential pins provided on both sides of the pair of differential transmission signaling pins, the two stable potential pins having potentials different from each other, the connector comprising:

a first and a second contact terminals that are adjacent to each other for differential transmission and respectively connected to the pair of differential transmission signaling pins; and a third and a fourth contact terminals provided on both sides of the first and the second contact terminal, the third contact terminal adjacent to the first contact terminal being connected to one of the two stable potential pins, and the fourth contact terminal adjacent to the second contact terminal having a potential identical to that of the third contact terminal.

2. The high-speed interface connector according to claim 1, further comprising:

a fifth contact terminal connected to the other of the two stable potential pins.

3. The high-speed interface connector according to claim 1, wherein an interval between portions of the first contact terminal and the third contact terminal that extend adjacently and parallelly to each other is equal to an interval between portions of the second contact terminal and the fourth contact terminal that extend adjacently and parallelly to each other.

4. The high-speed interface connector according to claim 1, wherein the first contact terminal and the second contact terminal have line-symmetric shapes, and the third contact terminal has a portion that extends adjacently and parallelly to a portion of the first contact terminal, the portion of the third contact terminal and the fourth contact terminal have line-symmetric shapes.

5. The high-speed interface connector according to claim 1, wherein the third contact terminal includes a portion that extends adjacently and parallelly to the first contact terminal, and the portion of the third contact terminal that extends adjacently and parallelly to the first contact terminal has line-symmetric shape with the fourth contact terminal.

6. The high-speed interface connector according to claim 1, wherein an interval between a portion of the third contact terminal and first contact terminal that extends adjacently and parallelly each other is equal to an interval between the second contact terminal and the fourth contact terminal, and the portion of the third contact terminal that extends adjacently and parallelly to the first contact terminal has a width equal to a width of the fourth contact terminal.

7. The high-speed interface connector according to claim 1, wherein the differential transmission system signal pin arrangement is a differential transmission system signal pin arrangement for the memory card.

8. A memory card socket that supports a memory card for a differential transmission system including: a card pin arrangement, in which a first and a second pins adjacent to each other are differential transmission signaling pins, out of a third and a fourth pins that are disposed on both sides of the pair of the first and the second pins, the third pin is adjacent to the first pin and on the side opposite of the second pin with respect to the first pin, the fourth pin is adjacent to the second pin and on the side opposite of the first pin with respect to the second pin, the third and the fourth pins have potentials different from each other; and a fifth pin connected to a stable potential identical to that of the fourth pin, the memory card socket comprising:

a first and a second differential transmission contact terminals that are adjacent to each other and respectively connected to the first and the second differential transmission signaling pins of the memory card; and a third and a fourth contact terminals provided on both sides of the pair of the first and the second contact terminals, the third contact terminal being adjacent to the first contact terminal and positioning on the side opposite of the second contact terminal with respect to the first contact terminal, the fourth contact terminal being adjacent to the second contact terminal and positioning on the side opposite of the first contact terminal with respect to the second contact terminal, wherein the fourth contact terminal is connected to the fourth pin of the memory card, and the third contact terminal is connected to the fifth pin connected to the stable potential identical to that of the fourth pin instead of the third pin of the memory card.

9. The memory card socket according to claim 8, wherein an interval between portions of the first contact terminal and the third contact terminal that extend adjacently and parallelly to each other is equal to an interval between portions of the second contact terminal and the fourth contact terminal that extend adjacently and parallelly to each other.

10. The memory card socket according to claim 8, wherein the third contact terminal includes a portion that extends adjacently and parallelly to the first contact terminal, and the third contact terminal has a shape that connects to the fifth pin of the memory card in a manner such that an interval with the first contact terminal is enlarged at a portion connected to the fifth pin of the memory card.

11. The memory card socket according to claim 10, wherein a width of the third contact terminal has a portion that extends adjacently and parallelly to the first contact terminal, the portion having a width greater than a width of the fourth contact terminal.

12. The memory card socket according to claim 10, wherein the third contact terminal separately includes a portion that extends parallelly to the first contact terminal without changing an angle toward the first contact terminal when viewing a direction of fixing the third contact terminal on the memory card socket at the portion connected to the fifth pin of the memory card.

13. The memory card socket according to claim 8, wherein the first contact terminal and the second contact terminal have line-symmetric shapes, and the third contact terminal has a portion that extends adjacently and parallelly to the first contact terminal, the portion of the third contact terminal has line-symmetric shape with the fourth contact terminal.

14. The memory card socket according to claim 13, wherein the portion of the third contact terminal that extends parallelly to the first contact terminal has line-symmetric shape with the fourth contact terminal, and the third contact terminal separately includes a portion that extends parallelly to the first contact terminal without changing an angle toward the first contact terminal when viewing a direction of fixing the third contact terminal on the memory card socket at the portion connected to the fifth pin of the memory card.

15. The memory card socket according to claim 13, wherein the third contact terminal includes a portion that extends adjacently and parallelly to the first contact terminal, and the portion of the third contact terminal that extends adjacently and parallelly to the first contact terminal has line-symmetric shape with the fourth contact terminal.

16. The memory card socket according to claim 8, further comprising:

a fifth contact terminal independent from the third contact terminal, the fifth contact terminal being connected to the fifth pin of the memory card.

17. The memory card socket according to claim 11, wherein an interval between a portion of the third contact terminal and the first contact terminal that extends adjacently and parallelly each other is equal to an interval between the second contact terminal and the fourth contact terminal, and the portion of the third contact terminal that extends adjacently and parallelly to the first contact terminal has a width equal to a width of the fourth contact terminal.

* * * * *